US005821509A

United States Patent [19]

Razo

[11] Patent Number: 5,821,509

[45] Date of Patent: Oct. 13, 1998

[54] ARTIFICIAL TOOTH MOLD SELECTOR

[75] Inventor: Rudy Razo, Lompoc, Calif.

[73] Assignee: American Tooth Industries, Oxnard, Calif.

[21] Appl. No.: 422,144

[22] Filed: Oct. 16, 1989

[51] Int. Cl.[6] ..... G06G 1/02

[52] U.S. Cl. ..... 235/70 A

[58] Field of Search ..... 235/69, 70 A, 235/70 R; 434/263

[56] References Cited

U.S. PATENT DOCUMENTS 2,832,252 4/1958 Gabriel ..... 235/70 R X 2,874,487 2/1959 Bloom et al. ..... 434/263

3,045,906 7/1962 Burg ..... 235/70 R 3,933,305 1/1976 Murphy ..... 235/70 A

*Primary Examiner*—Brian W. Brown

*Attorney, Agent, or Firm*—Emrich & Dithmar

[57] ABSTRACT

A tooth mold is selected by operating a device consisting of a card having a first and second side and a plurality of strips disposed therebetween. Each side of the card and each side of the strip is provided with descriptive material for specific data. The sides of the card are also provided with windows so that manipulation of the strips will provide the necessary form of the mold.

11 Claims, 12 Drawing Sheets

10
16
26
SIDE ONE
12
ARTIFICIAL TOOTH MOLD SELECTOR
MOLD DETAIL
GENERAL INSTRUCTIONS
5T
9T
1T
5S
8S
5N,1S,9S,10S
12S
1N
9N,2S,3S,4S
5M,7N,8N,10N,12N
2N,3N,4N,10N
1M,8M,9M,7S
7M,12M
5L,4M
38.80 40.61
41.42 43.2
42.73 44
44.04
44.35
46.6
47
49
50
51
5
5
SIDE ONE
45 46 47 48 49 50 51 52 53 54 56 57 58 59 60 62 64 31 32 33 34 35 36 37 38 39 40 41 42 43 44 31 32
22
32
16
14
18

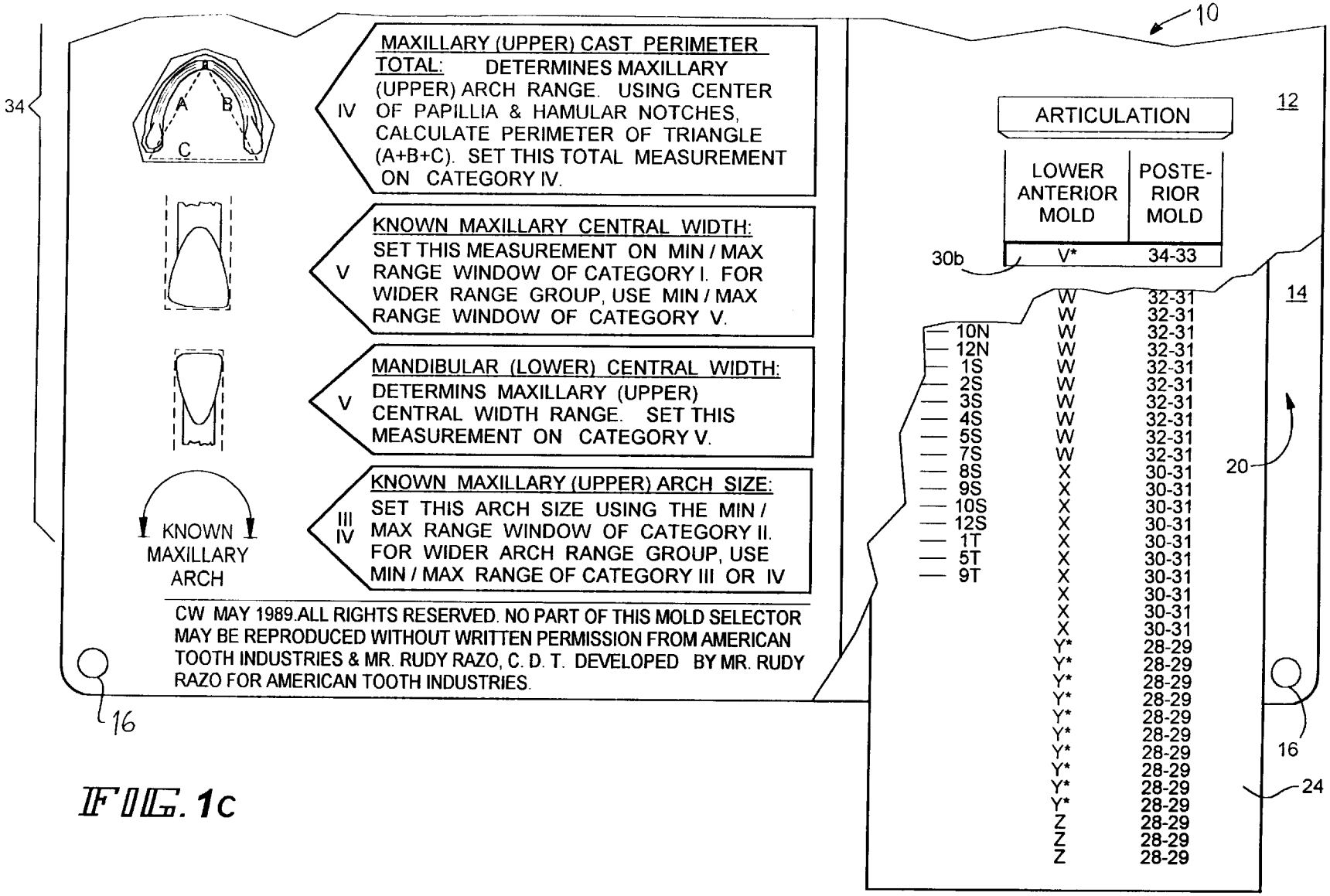
10
12
14
16
20
24
30b
34
ARTICULATION
LOWER ANTERIOR MOLD
POSTE-RIOR MOLD
V*
34-33
10N 12N 1S 2S 3S 4S 5S 7S 8S 9S 10S 12S 1T 5T 9T
W W W W W W W W X X X Side One

22

32

32

| | | | |
|---|---|---|---|
| --451 | | | 5T |
| --461 | | | 9T |
| --471 | | | 1T |
| --481 | | | 5S |
| --491 | | | 8S |
| --501 | | | 5N,1S,9S,10S |
| --511 | | | 12S |
| --521 | | | 1N |
| --531 | | | 9N,2S,3S,4S |
| --541 | | | 5M,7N,8N,10N,12N |
| --561 | | | 2N,3N,4N,10N |
| --571 | | | 1M,8M,9M,7S |
| --581 | | | 7M,12M |
| --591 | | | 5L,4M |
| --601 | | | 1L,9L,3M |
| --621 | | | 2M |
| --641 | | | 1G,5G,9G |
| --31II | 38.80 | 40.61 | 9T |
| --32II | 41.42 | 43.34 | 1T,5T,9T |
| --33II | 42.73 | 44.54 | 8S,10S |
| --34II | 44.04 | 45.85 | 1S,5S,7S,8S,9S,10S,12S |
| --35II | 45.35 | 47.16 | 1N,5N,2S,3S,4S,9S |
| --36II | 46.66 | 48.47 | 1N,5,8N,9N,10N,12N,2S,3S,4S |
| --37II | 47.97 | 49.78 | 5M,7N,8N,9N,12N |
| --38II | 49.28 | 51.09 | 1M,5M,9M,10M,12M,2N,3N,4N |
| --39II | 50.59 | 52.40 | 1M,8M,9M,12M |
| --40II | 51.90 | 53.71 | 9L,3M,4M,7M |
| --41II | 53.21 | 55.02 | 1L,5L,9L,2M,3M |
| --42II | 54.52 | 56.33 | 2M |
| --43II | 55.83 | 57.64 | 1G,5G |
| --44II | 57.14 | 58.95 | 5G,9G |
| --31III | 40.30 | 44.16 | 1T,5T,9T |
| --32III | 41.60 | 45.54 | 1S,5S,7S,8S,9S,10S,12S,1T,5T |
| --33III | 42.90 | 46.92 | 1S,5S,8S,9S,10S,12S |
| --34III | 44.20 | 48.30 | 1N,5N,8N,9N,10N,12N,1S,2S,3S,4S,5S,8S, |
| --34III | 44.20 | 48.30 | 9S,10S,12S |
| --35III | 45.50 | 49.68 | 5M,1N,5N,7N,8N,9N,10N,12N,2S,3S,4S,9S |
| --36III | 46.80 | 51.06 | 1M,5M,9M,10M,1N,2N,3N,4N,5N,7N,8N, |
| --36III | 46.80 | 51.06 | 9N,10N,12N |
| --37III | 48.10 | 52.44 | 1M,8M,9M,10M,12M,2N,3N,4N,5N,7N, |
| --38III | 49.40 | 53.82 | 9L,1M,3M,4M,5M,7M,8M,9M,10M,12M,2N, |
| --38III | 49.40 | 53.82 | 3N,4N |
| --39III | 50.70 | 55.20 | 1L,5L,9L,1M,2M,3M,4M,7M,8M,9M,12M |
| --40III | 52.00 | 56.58 | 1L,5L,9L,2M,3M,4M,7M |
| --41III | 53.30 | 57.96 | 1G,5G,9G,1L,5L,9L,2M,3M |
| --42III | 54.60 | 59.34 | 1G,5G,9G,2M |
| --43III | 55.90 | 60.72 | 1G,5G,9G |
| --44III | 57.20 | 62.10 | 5G,9G |

FIG. 2a

| | | | |
|---|---|---|---|
| --124IV | | | 1T,9T |
| --126IV | | | 1T,5T |
| --132IV | | | 8S,10S |
| --134IV | | | 1S,5S,7S,12S |
| --136IV | | | 9S |
| --140IV | | | 1N,5N,2S,3S,4S |
| --142IV | | | 8N,9N,10N,12N |
| --144IV | | | 8N,9N,12N |
| --146IV | | | 7N |
| --148IV | | | 5M,3N,4N |
| --150IV | | | 10M,2N,3N,4N |
| --152IV | | | 1M,9M,12M |
| --154IV | | | 8M |
| --156IV | | | 4M |
| --158IV | | | 7M |
| --160IV | | | 1L,5L,9L,3M |
| --162IV | | | 1L,5L |
| --164IV | | | 2M |
| --170IV | | | 1G |
| --172IV | | | 5G,9G |
| --4.3V | 6.45 | 6.96 | 5T |
| --4.4V | 6.60 | 7.12 | 5T,9T |
| --4.5V | 6.75 | 7.29 | 1T,5T,9T |
| --4.6V | 6.90 | 7.45 | 1T,5T,9T |
| --4.7V | 7.05 | 7.61 | 1S,5S,8S,10S,1T,9T |
| --4.8V | 7.20 | 7.77 | 5N,1S,5S,8S,9S,10S,1T |
| --4.9V | 7.35 | 7.93 | 5N,1S,5S,8S,9S,10S,12S |
| --5.0V | 7.50 | 8.10 | 1N,5N,9N,1S,2S,3S,4S,8S,9S,10S,12S |
| --5.1V | 7.65 | 8.26 | 1N,5N,7N,8N,9N,10N,12N,2S,3S,4S,9S,12S |
| --5.2V | 7.80 | 8.42 | 5M,1N,7N,8N,9N,10N,12N,2S,3S,4S,12S |
| --5.3V | 7.95 | 8.58 | 5M,1N,3N,4N,7N,8N,9N,10N,12N,2S,3S,4S |
| --5.4V | 8.10 | 8.74 | 1M,5M,8M,9M,10M,2N,3N,4N,7N,8N,9N, |
| --5.4V | 8.10 | 8.74 | 10N,12N,2S,3S,4S,7S |
| --5.5V | 8.25 | 8.91 | 1M,5M,7M,8M,9M,10M,12M,2N,3N,4N,7S |
| --5.6V | 8.40 | 9.07 | 8L,1M,4M,7M,8M,9M,10M,12M,2N,3N,4N,7S |
| --5.7V | 8.55 | 9.23 | 1L,5L,9L,1M,3M,4M,7M,8M,9M,10M,12M, |
| --5.7V | 8.55 | 9.23 | 2N,7S |
| --5.8V | 8.70 | 9.39 | 1L,5L,9L,1M,3M,4M,7M,8M,9M,12M,7S |
| --5.9V | 8.85 | 9.55 | 1L,5L,9L,2M,3M,4M |
| --6.0V | 9.00 | 9.72 | 1G,5G,1L,5L,9L,2M,3M |
| --6.1V | 9.15 | 9.88 | 1G,5G,9G,2M |
| --6.2V | 9.30 | 10.04 | 1G,5G,9G,2M |
| --6.3V | 9.45 | 10.20 | 1G,5G,9G |
| --6.4V | 9.60 | 10.36 | 1G,5G,9G |
| --6.5V | 9.75 | 10.53 | 9G |

Side One

| | | | |
|---|---|---|---|
| | 57.00 | 11.20 | 9.70 |
| | 57.50 | 13.20 | 9.70 |
| | 57.75 | 12.70 | 9.80 |
| | 54.00 | 10.50 | 9.10 |
| | 54.00 | 11.80 | 9.00 |
| | 53.50 | 12.00 | 9.10 |
| | 51.00 | 9.50 | 8.70 |
| | 54.80 | 10.80 | 9.40 |
| 24 | 53.50 | 12.00 | 9.10 |
| | 52.50 | 10.00 | 9.00 |
| | 49.50 | 11.20 | 8.30 |
| | 53.00 | 11.00 | 8.80 |
| | 51.50 | 10.90 | 8.70 |
| | 51.00 | 11.80 | 8.70 |
| | 50.50 | 10.80 | 8.60 |
| | 51.00 | 11.20 | 8.80 |
| | 47.00 | 8.60 | 8.00 |
| | 50.30 | 10.20 | 8.60 |
| | 50.00 | 11.20 | 8.50 |
| | 50.00 | 9.30 | 8.50 |
| 32 | 47.00 | 10.10 | 7.70 |
| | 49.00 | 10.20 | 8.20 |
| | 48.00 | 10.20 | 8.20 |
| | 48.00 | 11.00 | 8.10 |
| | 47.50 | 10.10 | 8.20 |
| | 48.00 | 10.80 | 8.20 |
| --1G | 44.70 | 8.60 | 7.60 |
| --5G | 47.00 | 9.80 | 8.10 |
| --9G | 47.00 | 10.50 | 8.10 |
| --1L | 47.00 | 8.70 | 8.10 |
| --5L | 45.00 | 9.80 | 7.40 |
| --9L | 45.20 | 10.80 | 8.70 |
| --1M | 44.50 | 9.70 | 7.50 |
| --2M | 45.50 | 10.20 | 7.70 |
| --3M | 44.50 | 9.70 | 7.60 |
| --4M | 45.00 | 10.20 | 7.80 |
| --5M | 42.00 | 8.00 | 7.20 |
| --7M | 42.00 | 9.00 | 6.90 |
| --8M | 41.50 | 9.70 | 7.10 |
| --9M | | | |
| --10M | | | |

FIG. 3a

| | | | |
|---|---|---|---|
| --12M | | | |
| --1N | U | | 34-33 |
| --2N | U | | 34-33 |
| --3N | U | | 34-33 |
| --4N | V• | | 34-33 |
| --5N | V• | | 34-33 |
| --7N | V• | | 34-33 |
| --8N | W | | 32-31 |
| --9N | W | | 32-31 |
| --10N | W | | 32-31 |
| --12N | W | | 32-31 |
| --1S | W | | 32-31 |
| --2S | W | | 32-31 |
| --3S | W | | 32-31 |
| --4S | W | | 32-31 |
| --5S | W | | 32-31 |
| --7S | W | | 32-31 |
| --8S | X | | 30-31 |
| --9S | X | | 30-31 |
| --10S | X | | 30-31 |
| --12S | X | | 30-31 |
| --1T | X | | 30-31 |
| --5T | X | | 30-31 |
| --9T | X | | 30-31 |
| | X | | 30-31 |
| | X | | 30-31 |
| | X | | 30-31 |
| 24 | Y• | | 28-29 |
| | Y• | | 28-29 |
| | Y• | | 28-29 |
| | Y• | | 28-29 |
| | Y• | | 28-29 |
| | Y• | 32 | 28-29 |
| | Y• | | 28-29 |
| | Y• | | 28-29 |
| | Y• | | 28-29 |
| | Z | | 28-29 |
| | Z | | 28-29 |
| | Z | | 28-29 |

FIG. 3b

Side Two

| | | | |
|---|---|---|---|
| --47I | | | 3M |
| --48I | | | 2C |
| --50I | | | 2N |
| --51I | | | 3C |
| --52I | | | 3D,3N,A26 |
| --54I | | | 1N,5P,264 |
| --55I | | | 2E,2P |
| --56I | | | A25 |
| --58I | | | 2D,4H,3P |
| --60I | | | 136 |
| --62I | | | 137,266,267 |
| --33II | 42.73 | 44.54 | 3M |
| --35II | 45.35 | 47.16 | 2C,2D,2N |
| --36II | 46.66 | 48.47 | 1N |
| --37II | 47.97 | 49.78 | 3C,3D,2E,1N,3N,5P,A25,264 |
| --38II | 49.28 | 51.09 | 2E,2P,A25,264 |
| --39II | 50.59 | 52.40 | 2P,A26 |
| --40II | 51.90 | 53.71 | 4H,3P,A26 |
| --41II | 53.21 | 55.02 | 136,266 |
| --42II | 54.52 | 56.33 | 266 |
| --43II | 55.83 | 57.64 | 137,267 |
| --32III | 41.60 | 45.54 | 3M |
| --33III | 42.90 | 46.92 | 2C,2D,2N,3M |
| --34III | 44.20 | 48.30 | 1N,2C,2D,2N |
| --35III | 45.50 | 49.68 | 1N,2C,2D,2E,2N,3C,3D,3N,5P,A25,264 |
| --38III | 46.80 | 51.06 | 1N,2E,2P,3C,3D,3N,5P,A25,264 |
| --37III | 48.10 | 52.44 | 2E,2P,3C,3D,3N,5P,A25,A26,264 |
| --38III | 49.40 | 53.82 | 2E,2P,3P,4H,A25,A26,264 |
| --39III | 50.70 | 55.20 | 2P,3P,4H,A26,138,266 |
| --40III | 52.00 | 56.58 | 3P,4H,A26,136,266 |
| --41III | 53.30 | 57.96 | 136,137,266,287 |
| --42III | 54.60 | 59.34 | 137,266,287 |
| --128IV | | | 3M |
| --138IV | | | 2C,2D,2N |
| --142IV | | | 1N |
| --144IV | | | 1N,3C,3D,3N,5P |
| --148IV | | | 2E,A25,264 |
| --152IV | | | 2P |
| --154IV | | | A26 |
| --158IV | | | 3P,4H,A26 |
| --162IV | | | 136 |
| --164IV | | | 266 |
| --170IV | | | 137,267 |
| --4.5V | 6.75 | 7.29 | 3M |
| --4.7V | 7.05 | 7.61 | 2C,3M |
| --4.9V | 7.35 | 7.93 | 2C,2N,3M |
| --5.0V | 7.50 | 8.10 | 2N,3C,3D,3N,A26 |
| --5.1V | 7.65 | 8.26 | 1N,2N,3C,3D,3N,5P,A26 |
| --5.2V | 7.80 | 8.42 | 1N,2E,2P,3C,3D,3N,5P,A26,264 |
| --5.3V | 7.95 | 8.58 | 1N,2E,2P,3D,3N,5P,A26,264 |
| --5.4V | 8.10 | 8.74 | 1N,2E,2P,5P,A25,264 |
| --5.5V | 8.25 | 8.91 | 2D,2E,2P,3P,4H,A25,264 |
| --5.6V | 8.40 | 9.07 | 2D,2E,2P,3P,4H,A25 |
| --5.7V | 8.55 | 9.23 | 2D,3P,4H,A25,136 |
| --5.8V | 8.70 | 9.39 | 2D,3P,4H,136 |
| --5.9V | 8.85 | 9.55 | 2D,4H,136,137,266,287 |
| --6.1V | 9.15 | 9.88 | 136,137,266,287 |

22

32

32

FIG.5a

| | | | |
|---|---|---|---|
| --6.2V | 9.30 | 10.04 | 137,266,287 |
| --6.3V | 9.45 | 10.20 | 267 |
| --48I | | | E1 |
| --49I | | | C1,D1 |
| --51I | | | E2,F1,H4 |
| --52I | | | B3,C2,D2,H2,J3,K4 |
| --54I | | | A4,D3,E3,J5 |
| --56I | | | C6,E6,F4 |
| --58I | | | A7,B8,C5,E8,G5,G7 |
| --59I | | | D6,J2 |
| --34II | 44.04 | 45.85 | C1,D1,E1 |
| --35II | 45.35 | 47.18 | D2,E2,F1,H4 |
| --36II | 46.66 | 48.47 | C2,D2,H2,C4 |
| --37II | 47.97 | 49.78 | A4,B3,D3,J3,K4 |
| --38II | 49.28 | 51.09 | C5,C6,E3,F4,J3,J5 |
| --39II | 50.59 | 52.40 | C5,C6,E6,G5,J5 |
| --40II | 51.90 | 53.71 | A7,E6,J2 |
| --41II | 53.21 | 55.02 | B8,D6,E8,G7 |
| --42II | 54.52 | 56.33 | E8 |
| --32III | 41.60 | 45.54 | C1,D1,E1 |
| --33III | 42.90 | 46.92 | C1,D1,E1,D2,F1,H4 |
| --34III | 44.20 | 48.30 | C1,C2,D1,D2,E1,E2,F1,H2,HR,K4 |
| --35III | 45.50 | 49.68 | A4,B3,C2,D2,D3,E2,F1,H2,H4,J3,K4 |
| --36III | 46.80 | 51.06 | A4,B3,C2,C5,C6,D2,D3,E3,F4,H2,J3,J5,K4 |
| --37III | 48.10 | 52.44 | A4,B3,C5,C6,D3,E3,E8,F4,G5,J3,J5 |
| --38III | 49.40 | 53.82 | A7,C5,C6,E3,F4,G5,J2,J3,J5 |
| --39III | 50.70 | 55.20 | A7,B8,C5,C6,D6,E8,G5,G7,J2,J5 |
| --40III | 52.00 | 56.58 | A7,B8,D6,E6,E8,G7,J2 |
| --41III | 53.30 | 57.96 | B8,D6,E8,G7 |
| --42III | 54.60 | 59.34 | E8 |
| --134IV | | | C1,D1,E1 |
| --136IV | | | F1 |
| --138IV | | | E2,F1,H4 |
| --140IV | | | D2 |
| --142IV | | | C2,H2,K4 |
| --144IV | | | K4 |
| --146IV | | | A4,B3,D3 |
| --148IV | | | E3,F4,13 |
| --150IV | | | E3,F4 |
| --152IV | | | C5,C6,J5 |
| --154IV | | | E6,G5 |
| --156IV | | | A7,E6 |
| --158IV | | | J2 |
| --162IV | | | B8,D6,G7 |
| --164IV | | | E8 |
| --4.6V | 6.90 | 7.45 | E1 |
| --4.8V | 7.05 | 7.61 | C1,D1,E1 |
| --4.9V | 7.35 | 7.93 | C1,D1,E2,F1,H4 |
| --5.0V | 7.50 | 8.10 | B3,C1,C2,D1,D2,E2,F1,H2,H4,J3,K4 |
| --5.1V | 7.65 | 8.26 | B3,C2,D2,E2,F1,H2,H4,J3,K4 |
| --5.3V | 7.80 | 8.42 | A4,B3,C2,D2,D3,E2,E3,F1,H2,H4,J3,J5,K4 |
| --5.4V | 8.10 | 8.74 | A4,C6,D3,E3,E6,F4,J5 |
| --5.5V | 8.25 | 8.91 | A4,A7,B8,C5,C6,D3,E3,E6,E8,F4,G5,G7,J5 |
| --5.6V | 8.40 | 9.07 | A7,B8,C5,C6,D6,E6,E8,F4,G5,G7,J2 |
| --5.8V | 8.70 | 9.39 | A7,B8,C5,D6,E8,G5,G7,J2 |
| --6.0V | 9.00 | 9.72 | D6,J2 |

22

32

32

FIG.5b

| | | | | |
|---|---|---|---|---|
| Side Two | 49.00 | 10.00 | 8.30 | □ |
| | 52.50 | 10.00 | 8.80 | □ |
| | 49.00 | 9.50 | 8.00 | □○ |
| | 54.00 | 11.30 | 8.80 | □○ |
| | 45.00 | 10.00 | 7.50 | □△ |
| | 47.50 | 10.00 | 8.00 | □△ |
| | 51.00 | 11.80 | 8.80 | □△ |
| | 51.00 | 10.80 | 8.50 | □△ |
| 24 | 45.00 | 10.00 | 7.50 | □△ |
| | 47.00 | 10.00 | 8.00 | □△ |
| | 49.00 | 10.50 | 8.30 | □△ |
| | 54.00 | 12.00 | 9.00 | □△ |
| | 45.00 | 9.30 | 7.30 | △ |
| | 46.50 | 10.00 | 7.80 | △ |
| | 50.00 | 10.50 | 8.30 | △ |
| | 52.00 | 10.00 | 8.50 | △ |
| | 55.00 | 11.00 | 8.80 | △ |
| | 46.00 | 8.50 | 7.80 | △ |
| | 50.00 | 9.00 | 8.50 | △ |
| | 51.50 | 10.50 | 8.80 | △ |
| --A4 | 54.00 | 10.80 | 8.80 | △ |
| --A7 | 47.50 | 10.00 | 8.00 | △○ |
| --B3 | 46.50 | 10.00 | 7.80 | △○ |
| --B8 | 53.00 | 11.50 | 9.00 | ○ |
| --C1 | 49.50 | 10.80 | 8.00 | ○ |
| --C2 | 51.00 | 10.50 | 8.30 | ○ |
| --C5 | 48.00 | 10.00 | 8.00 | □△○ |
| --C6 | 46.50 | 10.50 | 7.40 | □○ |
| --D1 | 48.50 | 8.80 | 7.80 | □○ |
| --D2 | 46.50 | 10.30 | 8.90 | □ |
| --D3 | 48.50 | 9.60 | 8.00 | □○ |
| --D6 | 49.50 | 10.40 | 8.40 | □○ |
| --E1 | 52.50 | 10.30 | 8.90 | □○ |
| --E2 | 43.00 | 8.90 | 7.20 | △ |
| --E3 | 48.00 | 9.60 | 8.20 | △ |
| --E6 | 46.50 | 9.80 | 7.70 | △ |
| --E8 | 48.50 | 10.90 | 8.00 | △ |
| --F1 | 51.00 | 11.00 | 8.40 | △ |
| --F4 | 52.50 | 10.80 | 8.80 | △ |
| --G5 | 48.50 | 10.50 | 8.20 | △□ |
| --G7 32 | 49.50 | 9.30 | 8.60 | △ |
| --H2 | 52.00 | 10.00 | 8.00 | △ |
| --H4 | 54.50 | 10.70 | 9.20 | □ |
| --J2 | 57.00 | 11.00 | 9.40 | □ |
| --J3 | 49.50 | 10.80 | 8.30 | △ |
| --J5 | 55.00 | 12.20 | 9.40 | △ |
| --K4 | 57.00 | 12.60 | 9.50 | △ |

FIG. 6a

| | | |
|---|---|---|
| --2C | | |
| --3C | | |
| --2D | 4 | 30-31 |
| --3D | 7 | 32-31 |
| --2E | 3 | 28-29 |
| --4H | 8 | 32-31 |
| --3M | 1 | 28-29 |
| --1N | 2 | 28-29 |
| --2N | 5 | 32-31 |
| --3N | 6 | 32-31 |
| --2P | 1 | 28-29 |
| --3P | 2 | 28-29 |
| --5P | 3 | 30-31 |
| --A25 | 6 | 34-33 |
| --A26 | 1 | 28-29 |
| --136 | 2 | 30-31 |
| --137 | 3 | 30-31 |
| --264 | 6 | 32-31 |
| --266 | 8 | 32-31 |
| --267 | 1 | 28-29 |
| | 4 | 30-31 |
| | 5 | 32-31 |
| | 7 | 32-31 |
| | 2 | 28-29 |
| | 4 | 30-31 |
| | 2 | 28-29 |
| | 3 | 28-29 |
| | 5 | 32-31 |
| | 4 | 28-29 |
| | 2C | 29M |
| | 3C | 29M |
| | 2D | 29L |
| | 3C | 29M |
| | 2E | 31M |
| | 4H | 31M |
| | 3M | 29M |
| 24 | 3N | 31M |
| | 2N | 29L |
| | 3N | 31M |
| | 2P | 31L |
| | 3P | 31M 32 |
| | 3N | 31L |
| | 46 | 30M |
| | 47 | 32M |
| | 47 | 32M |
| | 4H | 33M |
| | 2P | 31L |
| | 26 | 33L |
| | 3R | 34L |

FIG. 6b

ARTIFICIAL TOOTH MOLD SELECTOR

FIELD OF THE INVENTION

The present invention relates to a guide for selecting proper dental prosthesis and more particularly, the invention relates to an artificial tooth mold selector device.

BACKGROUND OF THE INVENTION

In the practice of dentistry, and particularly in the specialized practice of providing artificial dental prosthetics, the dentist serves a wide variety of patients, each of whom have a unique mouth geography. Generally, the dentist must not only select individual teeth that match the patient's original teeth as closely as possible, but he must also mold plates to support such teeth and to make the same look and conform to the patient's natural teeth and mouth geography without dramatically changing the patient's facial appearance, while at the same time, providing dentures that fit comfortably, as well as being aesthetically pleasing.

In carrying out the procedures for doing so, the dentist takes accurate impressions of the patient's endentulous mouth. Usually, a stone cast of the edentulous mouth is produced from an impression and it is left up to the dental technician to construct full or partial dentures.

The artificial denture plate is constructed by a laboratory with premolded artificial teeth and acrylic base material. Artificial teeth are manufactured by specialized factories. Each brand of artificial teeth consists of a large variety of anterior and posterior molds, both upper and lower. Each brand is also manufactured in more than 10 different shades. Artificial anterior upper tooth molds are considered the primary working reference for the lab technician. One full set of anterior upper teeth is comprised of 6 anterior teeth. The correct selection of the upper anterior artificial tooth mold by the laboratory technician (set-up man) is the most important procedure in constructing a denture. Manufacturers of teeth provide articulation charts that allow the technician to choose the pre-articulated upper posteriors and the pre-articulated lower anteriors and posteriors.

The dentist supplies the laboratory with the impressions and/or the stone casts together with a prescription which spells out the following information, such as shade number of acrylic teeth, certain facial characteristics, age of patient, whether the patient is male or female, and a cast of previous dentures (if available).

Therefore, in manufacturing a full upper and lower denture, the choice of the upper anterior mold is fundamental in setting up a case. This procedure becomes very difficult without having cosmetic data and measurement data of the patient's orofacial structure. Usually a very busy denture laboratory would have a full stock of artificial premolded teeth to allow the set-up man to select square, tapering or ovoid molds or a combination thereof. Also, the inventory allows the technician to select small, medium and large molds. For example, females generally have small teeth, and various ethnic groups fall into certain size categories. The inventory is also divided into many different shades. After the selection is made, a wax-up model of the denture is made with the help of the stone cast which is mounted on an instrument that simulates the movement of the patient's jaw. The flasking method is then used to construct the acrylic denture with its bonded teeth. The final product is commonly called a denture plate.

Until now, a well defined complete system has never been produced to allow the dentist to give the laboratory technician accurate information about the patient's cosmetic characteristics and measurement data of his or her face and mouth. However, many studies have been made regarding the relationship between the interpupillary width, the ala (nose) width and the size of natural teeth. Each of these relationships have been measured and classified, but no system is known to date which has successfully incorporated all of the data into instructions capable of being clearly and uniformly passed from dentist to technician.

The present invention seeks to provide such a system. It is the object of the present invention to provide a device integrating at least five of the aforementioned variables, into a mold selection system. The dentists, therefore, can now utilize the present mold selection system to transfer important information to the laboratory technician, allowing him or her to select with confidence the right artificial tooth mold that best resembles the patient's original teeth. The laboratory technician, by using the present mold selection system, is also now capable of verifying the doctor's information. In addition, he or she will be able to select the right tooth molds with accuracy, thereby achieving efficiency and a greater comfort level of quality control, function and aesthetics.

The present Artificial Tooth Mold Selector is a revolutionary device which establishes, with accuracy, the artificial tooth molds to be employed in a prosthetic case. This device is the missing link in a system which attempts to reproduce natural parts and functions of the patient's orofacial structure.

The foregoing advantages, as well as others, will be apparent from the following disclosure of the present invention.

BRIEF STATEMENT OF THE INVENTION

In accordance with the present invention, there is provided an artificial tooth mold selector comprising a card having a first side and a second side, each of which has a plurality of openings therein through which data may be selected relating to a number of informational categories determined by measuring facial, mandibular and maxillary attributes of the patient. The descriptive material includes instructional data for determining the respective measurements and applying the selected data to mold classes or size and mold detail. The data to be selected is contained on a plurality of strips, disposed between the sides of the card so as to be movable therein. The strips are printed on both of the opposing faces thereof, with measurement and category data, mold classes or sizes and mold detail data determined from following the instructional data from the first and second sides of the card.

Full details of the present invention are set forth in the following description of the invention.

IN THE DRAWINGS

In order to understand the disclosure more fully, reference is directed to the accompanying drawings of an artificial tooth mold selector according to the present invention and in which drawings:

FIGS. 1*a*–1*c* together illustrate a front view of one side of an artificial tooth mold selector card according to the present invention with the two movable strips shown disposed between the two sides of the card;

FIGS. 2*a* and 2*b* are front views of the wider strip shown in FIGS. 1*a*–1*c* completely removed from between the sides of the card;

FIGS. 3*a* and 3*b* are front views of the narrower strip shown in FIGS. 1*a*–1*c;*

FIGS. 4*a*–4*c* are views similar to that of FIGS. 1*a*–1*c* showing the reverse side of the selector card;

FIGS. 5*a* and 5*b* are views similar to that of FIGS. 2*a* and 2*b* showing the reverse side of the wider strip; and FIGS. 6*a* and 6*b* are views similar to that of FIGS. 3*a* and 3*b* showing the reverse side of the narrower strip.

DESCRIPTION OF THE PREFERRED EMBODIMENTS

Figure 1A:
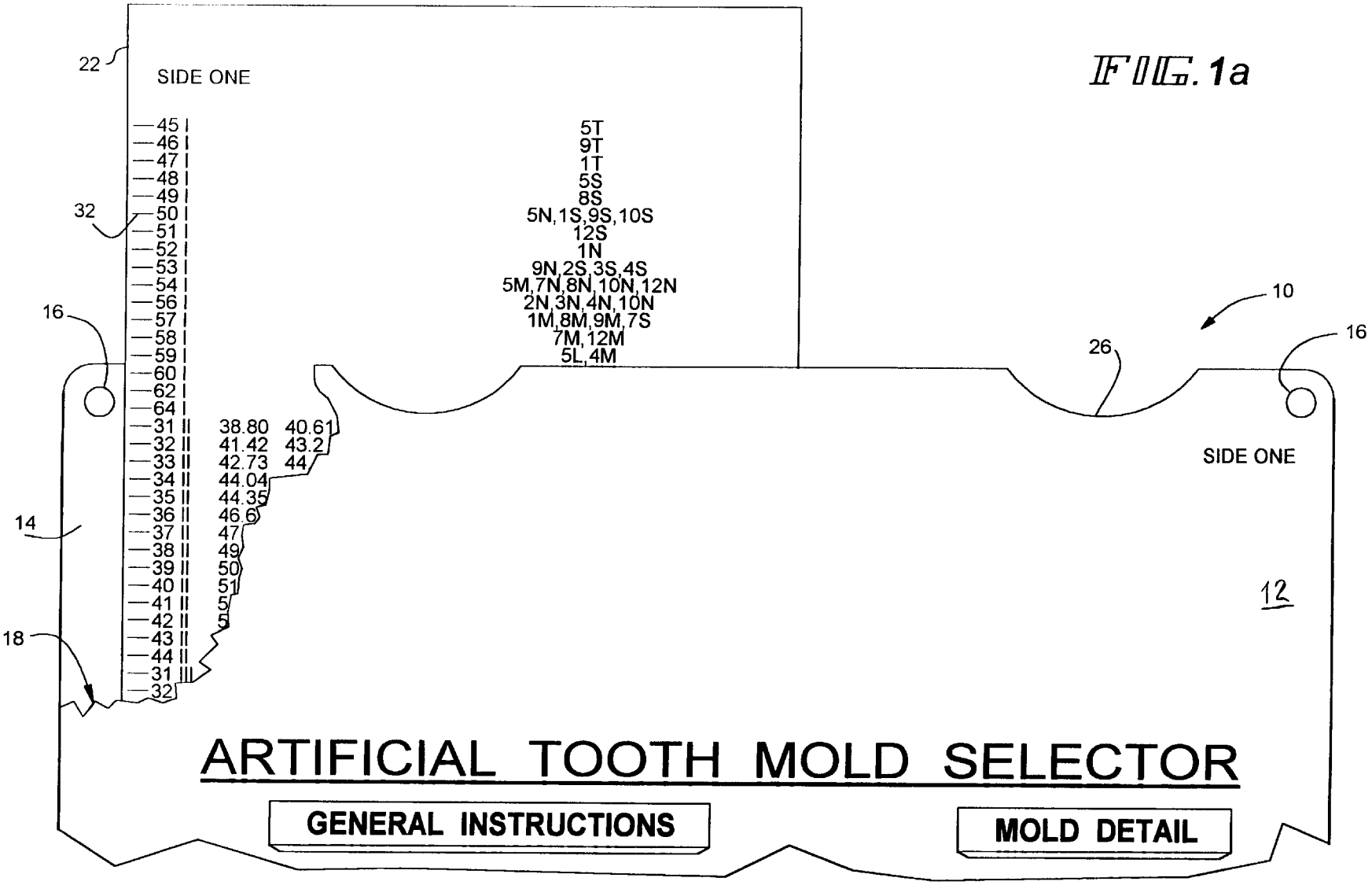
Figure 1B:
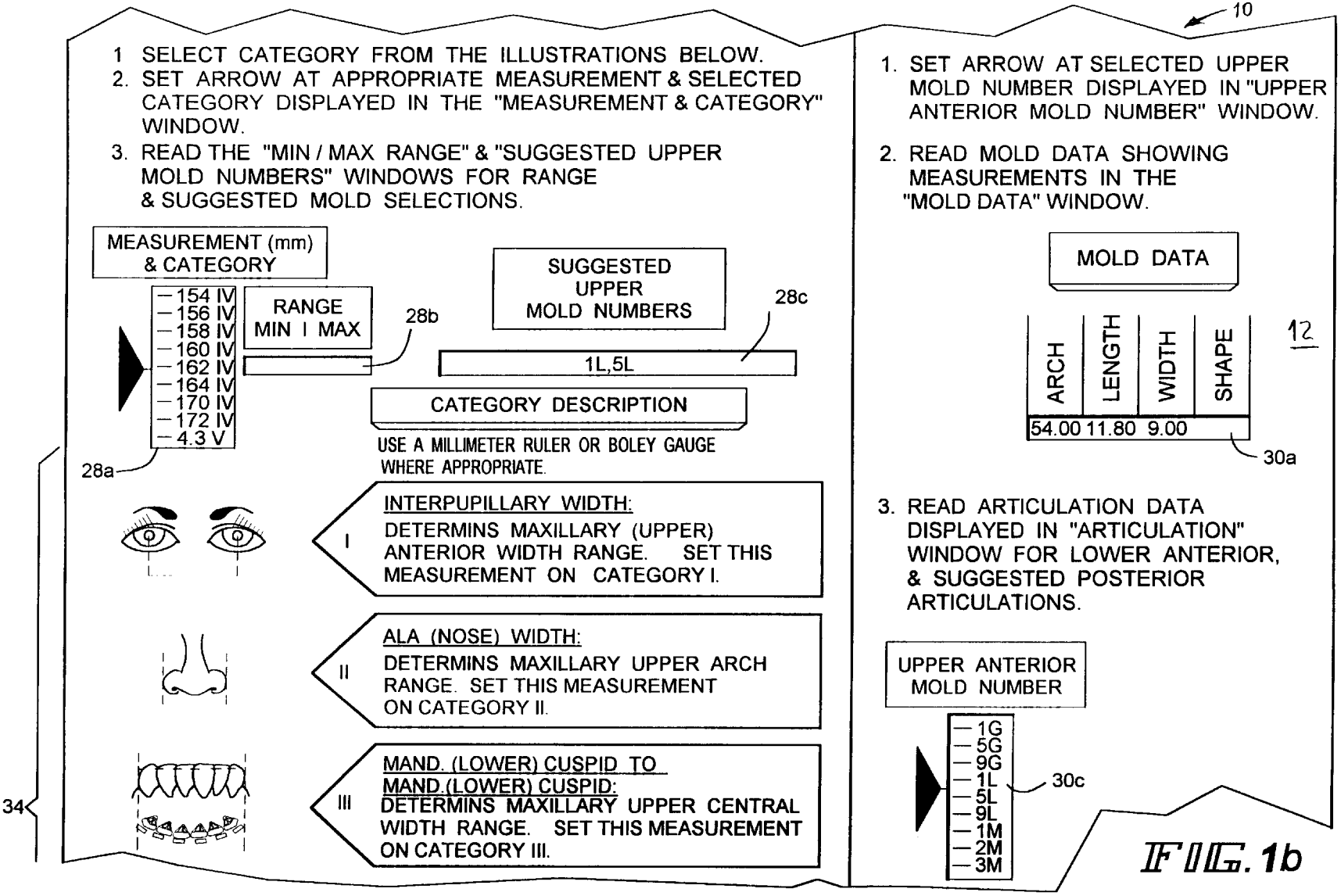
Figure 2B:
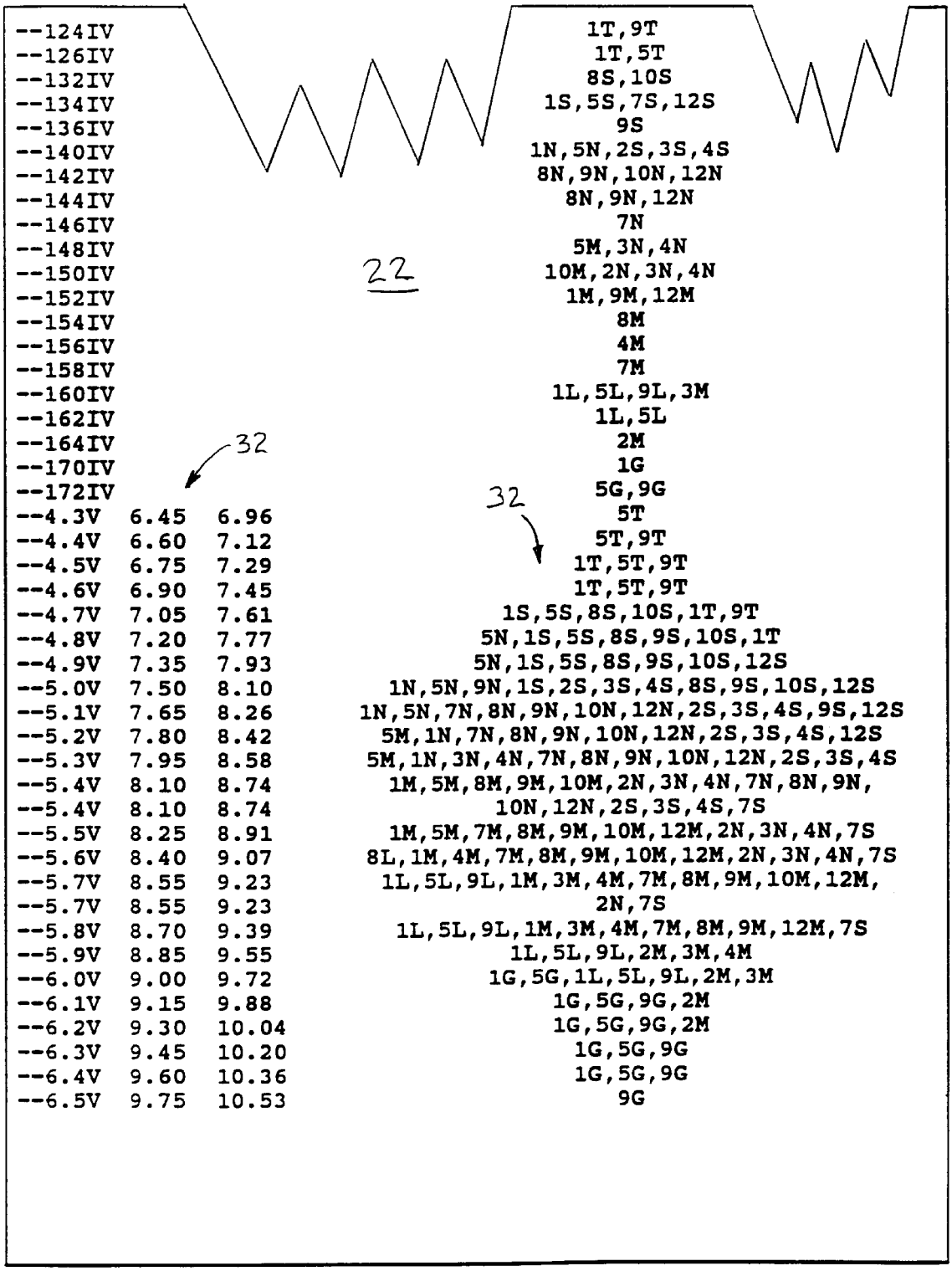
Figure 4A:
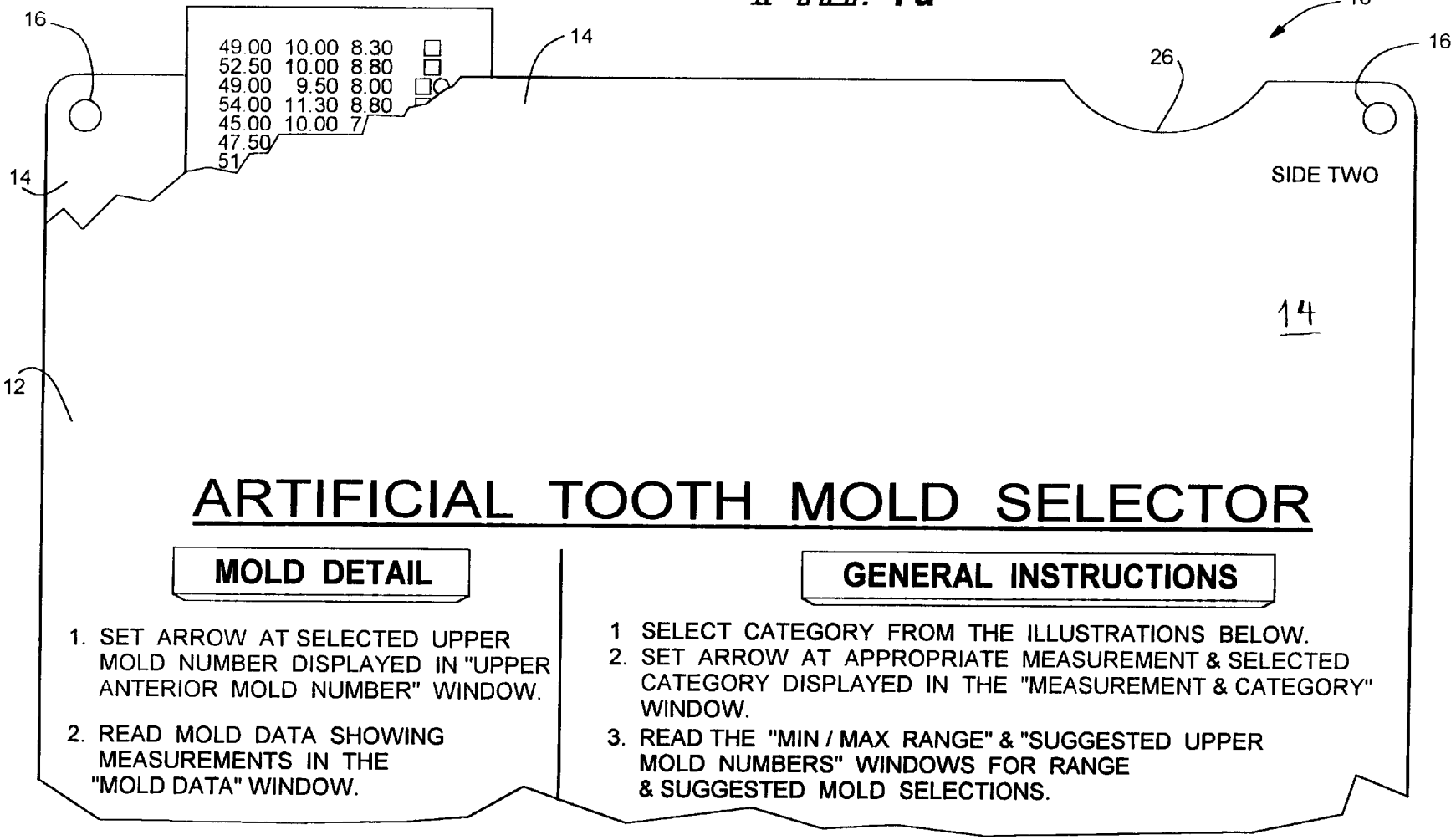
Figure 4B:
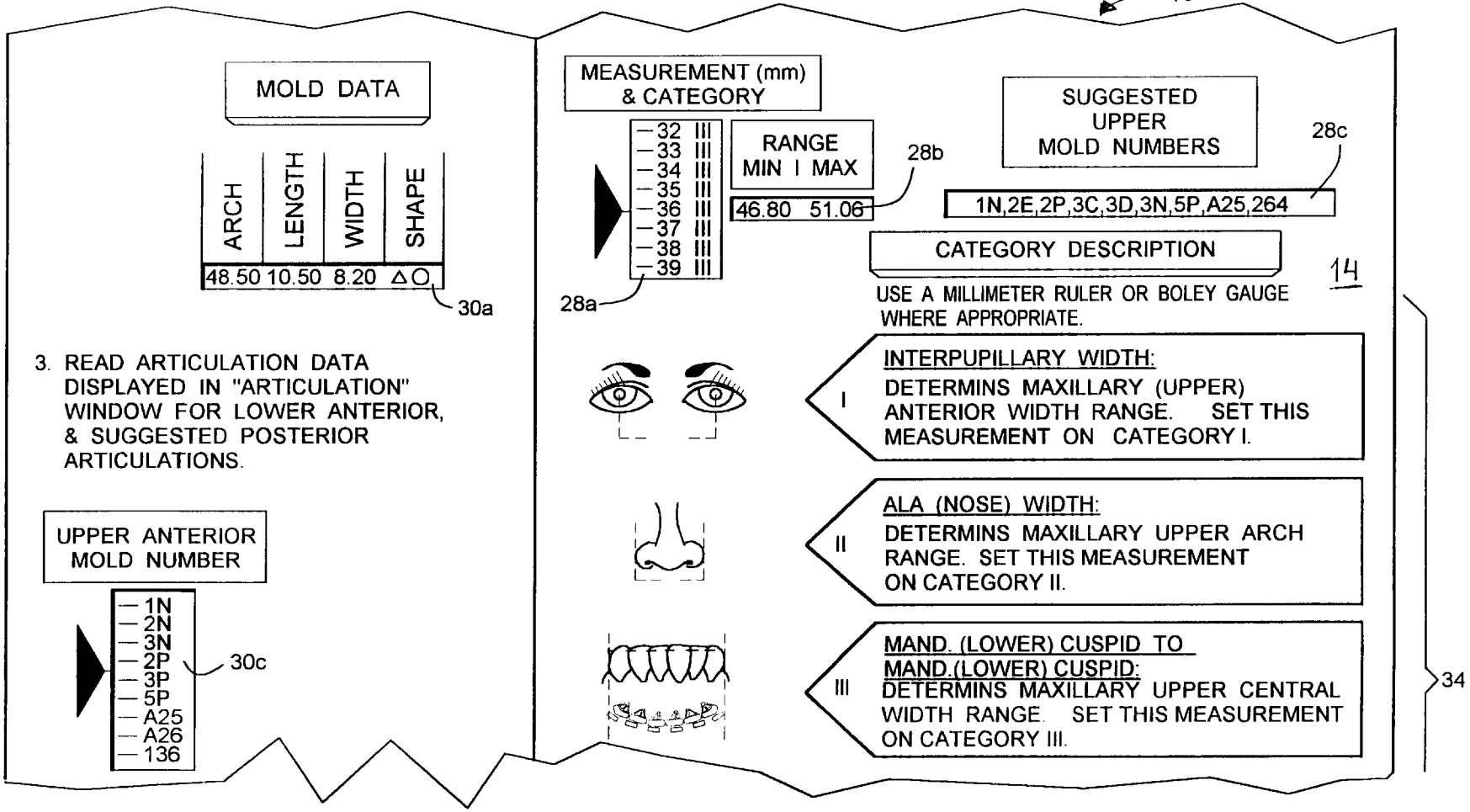
Figure 4C:
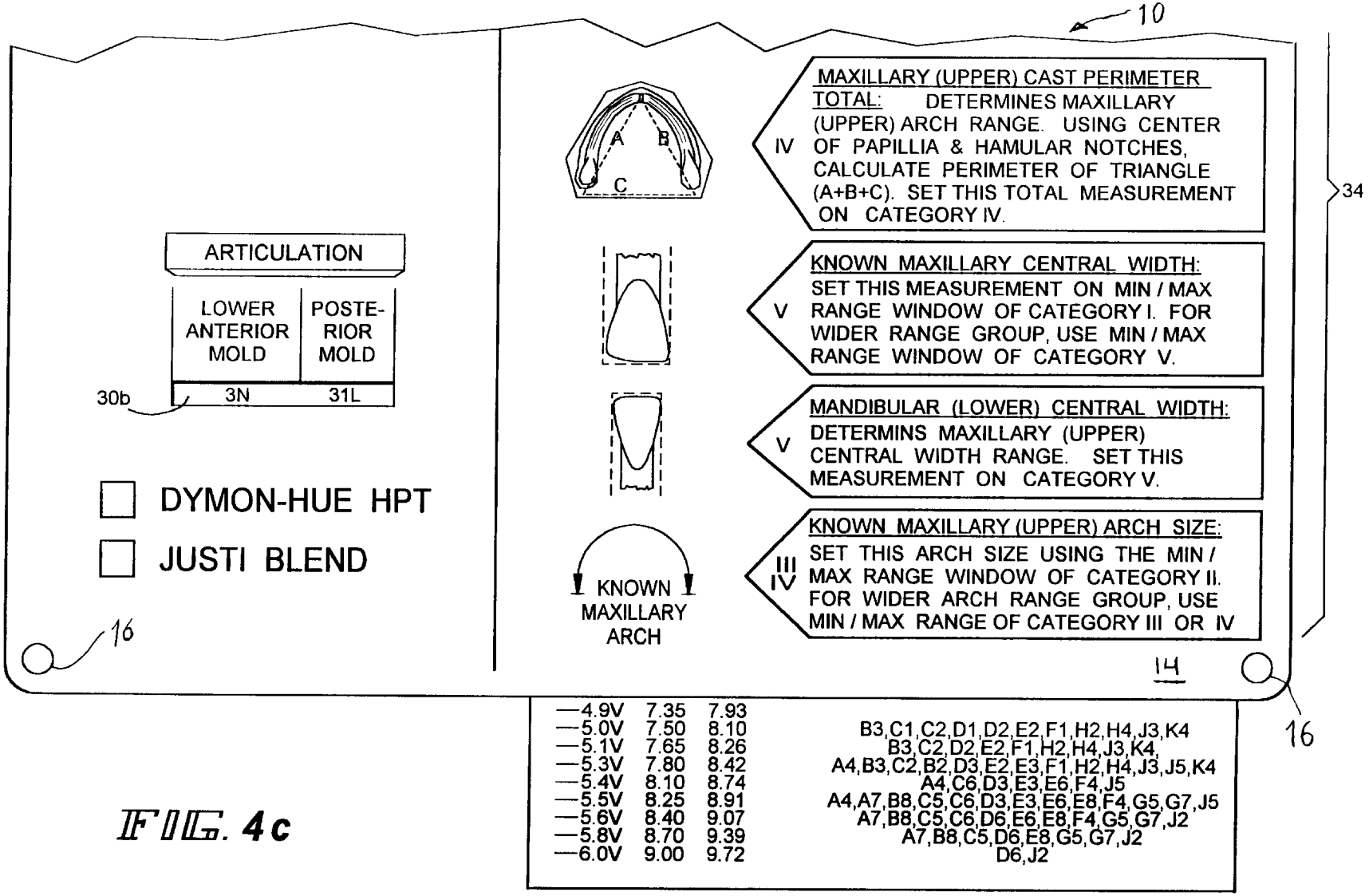

Referring now more particularly to FIG. 1*a*–1*c*, an artificial tooth mold selector according to the present invention, comprises what is generally referred to hereinafter as a card, depicted by the numeral 10. The card 10 comprises a rigid planar obverse or front wall 12 and an opposite reverse or rear wall 14. The front and rear walls are fastened together, preferably by rivets 16 located at their corners, although the walls may be glued or otherwise secured together. In securing the walls together, the walls 12 and 14 be in opposite hand relationship to each other and two longitudinal slots 18 and 20 are retained between the walls. One slot 18 is wider than the other slot 20.

Located within each slot, (i.e. slidably sandwiched between the walls) are rigid strips 22 and 24 of a width respectively conforming to the slots 18 and 20. The strips 22 and 24 are equal in length to the length of the walls 12 and 14, which walls are provided with semi circular cut outs 26 at the top and bottom enabling a user to grip each strip easily.

The selector card is intended to provide instructional and informational data for the selection of molds, shapes, etc., for at least three different prosthetic systems. Accordingly, the resultant data accumulated relative to each side is arranged for a respective system. Nevertheless, certain features and structural details are the same for each side. Thus, each wall 12 and 14 is formed with a plurality of window openings arranged at predetermined intervals or positions within the confines of the respective slots. In the area of the wider strip 22, a window 28*a* extends vertically, while two windows 28*b* and 28*c* extend horizontally along a common line perpendicular to and central of the horizontal window 28*a*. In the area of the narrower strip 24, two windows 30*a* and 30*b* extend horizontally one below the other while a third window 30*c* extends vertically between them and slightly off set.

Arranged exteriorly of the windows on the face 12 are a plurality of sections containing descriptive material defining the categories of instructional data for manipulating the two strips 22, 24. For example, in combination with the wider strip 22, the categories relate to the measurements of facial attributes such as the interpupillary, mandibular, and maxillary attributes I to V. By following the instructional data for manipulating the strips from either side, the dentist will determine the mold classes or sizes and mold detail data for each of the prosthetic systems.

The strips 22 and 24 are movable longitudinally in relation to the windows 28*a*, 28*b*, 28*c* and 30*a*, 30*b*, 30*c* in the card face. Each of the strips 22 and 24 have printed on their obverse and reverse surfaces, a series of numerical data 32 (corresponding to mold classes, sizes and mold detail data) associated with the particular dental appliance to be formed with the resultant material found by manipulation of the strips. The series of numerical data on the strips are arranged in vertical columns spaced to respectively correspond to one or more of the respectively aligned windows. Since the one surface of the strips 22 and 24 face one side of the card and the other surface of the strips 22 and 24 face the other side of the card, the respective data register with the windows 28 and 30, also in an opposite hand arrangement. Consequently the series of numbers on each side of the respective strips are located in classified vertical rows whereby the data corresponds to the specific window for which it was intended. The information located on each side of the strip is different from the other, as it forms a continuous series of data for a selected one of the prosthetic systems.

The data contained on the strips provide those specific and predetermined measurements and class codes by which specific teeth are categorized in its selected system, as well as a correlation to specific molds for obtaining the artificial equivalent thereof. Thus, by locating in window 28*a*, the measurements and categories obtained from the instruction boxes defined generally by the numeral 34, the most appropriate mold by number, etc., is found in the corresponding windows. To select the suggested mold, the small strip can be manipulated to provide specific mold data.

Various modifications, changes and embodiments have been shown and others will be obvious to those skilled in the art. Accordingly, it is intended that the present disclosure be taken as obvious and not limiting to the present invention.

What is claimed is:

1. An artificial tooth mold selector comprising a card having a first side and a second side joined about a portion of their periphery to define a spaced therebetween and a plurality of strips, each having opposing faces, said strip being slidably disposed in the space between said sides, each of said sides having first and second groups of openings therein, each of said first and second groups of openings having input openings and output openings, one of said strips registering with the first group of openings, and the other of said strips registering with the second group of openings, the first and second sides of said card having descriptive material printed on the surfaces of each side in juxtaposition to said first and second groups of openings, respectively defining a plurality of mouth structure categories containing data determined by measuring facial, mandibular and maxillary attributes of a patient, including instructional data for determining the data in each category and defining categories containing specific mold classes and specific mold detail data, each of said strips having printed on the opposing faces thereof data in alpha/numeric form corresponding to said categories on said first and second sides of said card, said data registering with the output openings and data corresponding to specific tooth molds, said alpha/numeric data being arranged so that the measurements required by the instructional data are selectively located in a predetermined input opening and the mold class and mold detail data thereof are registerable and readable in the output opening in the corresponding group, whereby successive manipulation of said strips select predetermined articifial tooth mold indicia conforming to the mouth structure.

2. The artificial tooth mold selector according to claim 1, wherein said first and second sides of said card are opposite hand identities of each other.

3. The artificial tooth mold selector according to claim 1, wherein the data printed on the opposing faces of each of the strips is different.

4. The artificial tooth mold selector according to claim 3, wherein the mold class data and mold detail data is printed on the opposing faces of the strip is directly readable through the openings in the first and second sides of the card.

5. The artificial tooth mold selector according to claim 1, wherein an attribute to be determined is the interpupillary width of a patient.

6. The artificial tooth mold selector according to claim 1, wherein an attribute to be determined is the nose width of a patient.

7. The artificial tooth mold selector according to claim 1, wherein an attribute to be determined is the mandibular cuspid width of a patient.

8. The artificial tooth mold selector according to claim 1, wherein an attribute to be determined is the maxillary upper cast perimeter total.

9. The artificial tooth mold selector according to claim 1, wherein an attribute to be determined is the mandibular central width.

10. The artificial tooth mold selector according to claim 1, wherein an attribute to be determined is a min/max range of a given or measured width of a maxillary central anterior tooth.

11. The artificial tooth mold selector according to claim 1, wherein an attribute to be determined is a min/max range of a given or measured maxillary arch size.

* * * * *